US005389510A

United States Patent [19]

Preddy et al.

[11] Patent Number: 5,389,510

[45] Date of Patent: Feb. 14, 1995

[54] PHOTOGRAPHIC ELEMENTS CONTAINING ALKYNYLAMINE DOPANTS

[75] Inventors: Carl R. Preddy, Rochester; Wai K. Lam, Webster; Roger Lok, Rochester, all of N.Y.

[73] Assignee: Eastman Kodak Company, Rochester, N.Y.

[21] Appl. No.: 169,832

[22] Filed: Dec. 16, 1993

[51] Int. Cl.[6] ..... G03C 1/10

[52] U.S. Cl. ..... 430/567; 430/569; 430/600; 430/607; 430/613; 430/614

[58] Field of Search ..... 430/567, 569, 600, 607, 430/613, 614

[56] References Cited

U.S. PATENT DOCUMENTS

| | | | |
|---|---|---|---|
| T. 103,803 | 1/1984 | Lok et al. | 548/121 |
| T. 104,802 | 11/1984 | Parton | 430/600 |
| T. 104,903 | 12/1984 | Lok et al. | 260/239 |
| 2,490,745 | 12/1948 | Carroll | 95/7 |
| 3,782,959 | 1/1974 | Bigelow | 96/107 |
| 4,115,122 | 9/1978 | Adachi et al. | 430/598 |
| 4,150,993 | 4/1979 | Suga et al. | 96/64 |
| 4,256,830 | 3/1981 | Jager et al. | 430/607 |
| 4,378,426 | 3/1983 | Lok et al. | 430/505 |
| 4,451,557 | 5/1984 | Lok et al. | 430/505 |
| 4,576,905 | 3/1986 | Gunther et al. | 430/401 |
| 4,933,272 | 6/1990 | McDugle et al. | 430/567 |
| 5,252,451 | 10/1993 | Bell | 430/567 |
| 5,256,530 | 10/1993 | Bell | 430/567 |

FOREIGN PATENT DOCUMENTS

| | | | |
|---|---|---|---|
| 0369424 | 5/1990 | European Pat. Off. | G03C 1/035 |
| 0369491 | 5/1990 | European Pat. Off. | G03C 1/015 |
| 0325235 | 4/1993 | European Pat. Off. | G03C 1/08 |

*Primary Examiner*—Janet C. Baxter
*Attorney, Agent, or Firm*—Peter C. Cody

[57] ABSTRACT

The present invention relates to a photographic element comprising a silver halide emulsion, the emulsion comprising silver halide grains which contain an alkynylamine dopant. The presence of the alkynylamine dopant imparts to the photographic element the advantageous characteristic of increased sensitivity.

15 Claims, No Drawings

PHOTOGRAPHIC ELEMENTS CONTAINING ALKYNYLAMINE DOPANTS

FIELD OF THE INVENTION

This invention relates to photographic elements containing specific dopants and exhibiting improved sensitivity.

BACKGROUND OF THE INVENTION

In the conventional practice of photography, a light sensitive material, i.e. silver halide grain, is exposed to actinic radiation to form what is referred to in the art as a "latent image". The "latent image" is the invisible precursor of a useful visible image that appears upon photographic development; it is a record of the exposure that is invisible to the unaided eye.

Once the light sensitive material has been exposed, it is then developed to produce a visible image. Development occurs by subjecting the light sensitive material to a reducing agent (developer). The reducing agent is oxidized and, in the course of being oxidized, causes an exposure-dependent fraction of the silver halide to be converted to metallic silver. This metallic silver is visible and, in black and white photography, it forms the visible record. In color photography, the oxidized reducing agent reacts with a dye precursor (coupler) to form a visible dye record.

Because formation of the visible image is exposure dependent, it is a primary object in the photographic field to enhance the light sensitive material's sensitivity to light. Increased light sensitivity results in an increased density of the visible image for each given level of exposure. It allows for images to be photographically recorded in poorly lit environments. Moreover, it allows for the construction of films yielding superior image quality.

It is known to improve the sensitivity (also referred to as "speed") of silver halide grains—which are typically contained in a gelatinous emulsion—by incorporating into their internal structure various non-silver or non-halide impurities. Such impurities are termed dopants, and they are typically added during silver halide precipitation. Examples of dopants can be found in European Patent Applications 0325235 and 0475298, and in U.S. Pat. Nos. 4,835,093 and 4,933,272.

It is also known to incorporate impurities onto the surfaces of silver halide grains in order to achieve sensitization. Such impurities are termed grain surface modifiers; they are added to the photographic emulsion after precipitation or ripening; and they are exemplified in U.S. Pat. Nos. 5,256,530 and 5,252,451.

Other means of increasing the sensitivity of silver halide emulsions include adjusting the pH and/or the pAg of the emulsion. Also, enhanced photographic sensitivity can be obtained by the addition of certain types of chemical sensitizers, typically as grain surface modifiers. Several types of sensitizers have been identified. The most prevalent are gold and sulfur compounds, both of which are thought to enhance emulsion speed by forming electron or photohole traps on the silver halide crystal surface.

Sensitization has also been accomplished by the addition of other transition metals. Specifically, platinum salts have been used, although sensitization with such salts is strongly retarded by gelatin. In addition, iridium salts and complex ions of rhodium, osmium, and ruthenium have been used as chemical sensitizers. The overall effect of these metals on sensitivity appears to be dependent upon their valence state.

Reduction sensitization is another means by which sensitivity enhancement can be obtained. Known reducing agents include stannous chloride, ascorbic acid (as in European Patent Applications 0369491 and 0369424) and dimethylamine borane (U.S. Pat. Nos. 4,150,093 and 3,782,959).

The use of sensitizers as described above often causes an indiscriminate, and undesirable, reduction of silver ions to silver atoms. The silver atoms, in turn, give rise during development to a generally or locally developed density that is not associated with the action of the image forming exposure. This density is typically termed fog and, for negative elements, it is best measured as the minimum density on the element's D-Log E curve ($D_{min}$); for positive (reversal) element's, it is best measured as the percent of Dmin relative to Dmax in a standard 6 minute E6 rehalogenation process.

In sensitized photographic silver halide elements, fog formation is often controlled by the addition of oxidants which impede the reduction of silver ions to metallic silver (or reverse the reaction). Addition of such oxidants, however, requires that a balance be struck between the desensitization effects of the oxidants and the sensitization effects of the sensitizer, a balance which is difficult to attain.

It is therefore desired to provide photographic light sensitive elements which exhibit increased sensitivity, and which do so without requiring the addition of oxidants to control fog formation.

Photographic silver halide elements, particularly sensitized ones, often also suffer from desensitization when subjected to mechanical pressure. This problem is severe in elements with silver halide grains exceeding 1 micron in size; and it is most acute in elements with silver halide grains having a tabular morphology.

It is therefore also desired to provide photographic light sensitive elements which exhibit increased sensitivity, but which do so without further exhibiting substantial desensitization when subjected to mechanical pressure.

SUMMARY OF THE INVENTION

The present invention provides a photographic element comprising a silver halide emulsion, said emulsion comprising silver halide grains which contain an alkynylamine dopant.

The presence of the alkynylamine dopant imparts to the photographic element the advantageous characteristic of increased sensitivity. This advantage can be realized without requiring the addition of oxidants to control fog formation. It can also be realized without deleteriously affecting the element's susceptability to pressure induced desensitization. These and other advantages of the present invention will be apparent from the description below.

DETAILED DESCRIPTION OF THE INVENTION

The ability of certain alkynylamines, namely those represented by the structure below, to produce increases in speed and latent image stability when incorporated into photographic emulsions as grain surface modifiers (post-precipitation) has been described in prior U.S. Pat. Nos. 4,378,426 and 4,451,557.

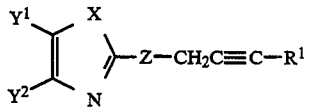

wherein:

X is —O—, —S—, —Se—, or

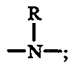

$Y^1$ and $Y^2$ individually represent hydrogen or an aromatic nucleus or together represent atoms completing a fused aromatic nucleus;

Z is

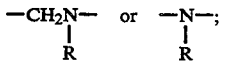

R is hydrogen or lower alkyl of from 1 to 5 carbon atoms; and $R^1$ is hydrogen or methyl.

In this invention, it has been discovered that the above speed advantages surprisingly can also be accomplished when alkynylamines are incorporated into a photographic element as dopants (as used herein, dopants are compounds added to a photographic emulsion during the precipitation of the emulsion's silver halide grains). Furthermore, the above speed advantages can be accomplished without substantially affecting the photographic element's susceptability to pressure-induced desensitization.

It has also been found with regard to the present invention that a particular subclass within the class of compounds represented by the above structure yields very substantive sensitivity gains when compared to the remainder of the class.

The present invention concerns photographic elements comprising silver halide grains which contain a compound of the formula $$Y—NHCH_2C{\equiv}CR^3$$

wherein $R^3$ represents a hydrogen atom, aliphatic, carbocyclic (including aryl), or heterocyclic group, which may be substituted or unsubstituted. Preferably, $R^3$ is other than hydrogen. More preferably, it is an alkyl having 1 to 20 carbon atoms. And optimally, it is a methyl group.

Examples of suitable aliphatic groups include methyl, ethyl, propyl, butyl, pentyl, hexyl, octyl, ethylhexyl, decyl, dodecyl, hexadecyl, octadecyl, isopropyl, t-butyl, butenyl, propynyl, and butynyl.

Examples of suitable carbocyclic groups are phenyl, tolyl, naphthyl, cyclohexyl, cycloheptatrienyl, cyclooctatrienyl, cyclononatrienyl, p-methoxyphenyl, and p-chlorophenyl.

Examples of suitable heterocyclic groups are pyrrole, furan, tetrahydrofuran, pyridine, picoline, piperidine, morpholine, pyrrolidine, thiophene, oxazole, thiazole, imidazole, selenazole, tellurazole, triazole, tetrazole, and oxadiazole.

The substituent represented by Y above is preferably a nitrogen containing heterocycle (including a heterocyclic ring system of two or more fused rings). Thus, Y includes substituted and unsubstituted oxazoles, thiazoles, selenazoles, oxadiazoles, thiadiazoles, triazoles, tetrazoles, pyrimidines, pyrroles, pyridines, quinolines, and benzimidazoles. Preferably, Y is a nitrogen containing azole.

Groups suitable for substitution on Y (as well as $R^3$) include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups, acylamino groups, sulfonylamino groups, cyano groups and acyloxy groups (for example, acetoxy, benzoxy), Preferred alkynylamines are ones in which the alkynylamine is substituted on the carbon of a N=C moiety as shown in the following structure:

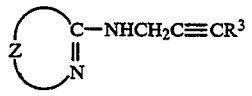

wherein Z represents atoms necessary to complete a five to nine-membered heterocyclic ring system, preferably a nine-membered fused heteroaromatic ring system such as a benzoxazole. $R^3$ in this structure is defined as above.

The most preferred alkynylamines contain benzoxazole, benzoselenazole, or benzothiazole moieties, and are represented by the following structure:

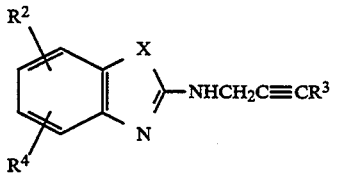

wherein X represents a substituted or unsubstituted nitrogen; or oxygen, sulfur, or selenium, preferably oxygen; $R^3$ is as defined above; and $R^2$ and $R^4$ independently represent hydrogen, a halogen, or a substituted or unsubstituted alkyl or alkoxy group, preferably one having from 1 to 10 carbon atoms.

In the alkynylamines described above, $R^2$ and $R^4$ are preferably in the 6 and 5 positions respectively. In such instances, the compounds of the present invention can have the following substituents for X, $R^2$, $R^3$, and $R^4$. This list is meant to be exemplary and not limiting as other substituents are contemplated to be within the scope of the invention.

TABLE I

| | | | |
|---|---|---|---|
| $R^2$ = H, | $R^3$ = Me, | and $R^4$ = H, | X = O |
| $R^2$ = H, | $R^3$ = Me, | and $R^4$ = Me, | X = O |
| $R^2$ = H, | $R^3$ = Me, | and $R^4$ = H, | X = S |
| $R^2$ = H, | $R^3$ = H, | and $R^4$ = H, | X = O |
| $R^2$ = H, | $R^3$ = H, | and $R^4$ = H, | X = S |

Specific compounds contemplated to be within the scope of the present invention include:

Compound A:

-continued

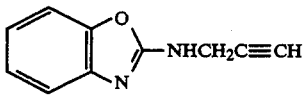

Compound B:

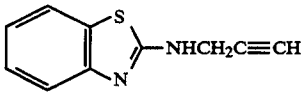

Compound C:

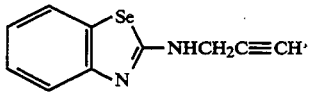

Compound D:

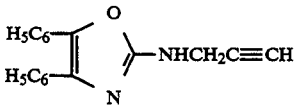

Compound E:

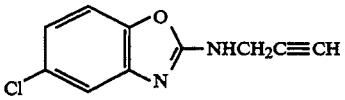

Compound F:

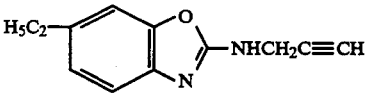

Compound G:

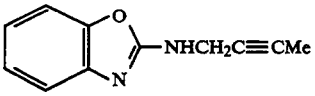

Compound H:

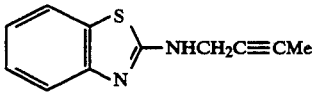

Compound I:

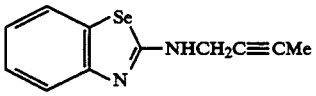

Compound J:

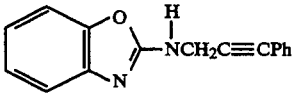

Compound K:

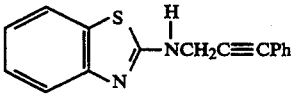

Compound L:

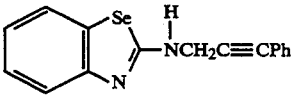

-continued

Compound M:

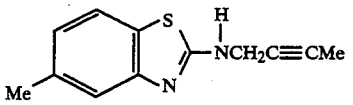

Compound M:

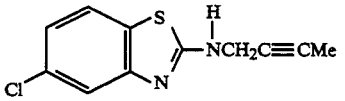

Compound O:

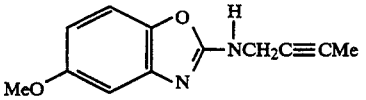

Compound P:

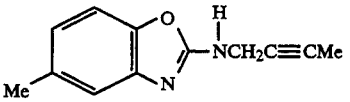

Compound Q:

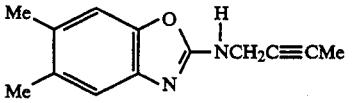

The photographic emulsion's silver halide grains are preferably precipitated in the presence of between about 0.001 and about 5.0 millimoles alkynylamine dopant per mole of silver. A more preferred level of incorporated alkynylamine is between about 0.002 and about 1 millimole per mole of silver; and an even more preferred level is between about 0.005 and about 0.1 millimole per mole of silver.

The preferred levels of alkynylamine can also vary depending upon the particular dopant, the particular stage of precipitation at which the dopant is added, and upon the particular effect desired. For instance, in elements wherein compound G is present during the precipitation of the outer 38 percent of each grain, it is desired to utilize levels less than 1.0 millimole per mole of silver. Ideally, levels less than 0.1 millimole per mole of silver are utilized.

For similar elements wherein the dopant is present during the precipitation of the outer 10 percent of each grain, it is preferred to utilize less than 0.003 millimole per mole of silver; most preferred is less than 0.002 millimole.

The alkynylamines of the present invention may be added to a black and white or color emulsion at any time during the formation of the silver halide grains, ideally during silver halide precipitation. Specifically, it is preferred that the alkynylamines be added after about 60 percent of the silver halide has precipitated. It is even more preferred that the alkynylamines be added to the emulsion after about 90 percent of the silver halide has precipitated. In the above instances, alkynylamines are intended to be added until 98 percent of the silver halide has precipitated, although it is contemplated to be within the scope of the invention that the alkynylamines be present during a banding (e.g. 20–70%) of each grain. Overall, it is desired, but not required, that the alkynylamines be incorporated during the formation of at least 10 percent of the volume of the silver halide grains.

It is also preferred that the above compounds be added to emulsions comprised of predominantly silver iodobromide. Although it is specifically contemplated that the advantages of the invention would be present in emulsions containing silver halide grains of any type (silver bromide, chloride, or iodide, or mixtures thereof) or form (i.e. cubic, octahedral, dodecahedral, spherical or tabular), a silver iodide content of less than 30 molar percent is preferred. Even more preferred is an emulsion containing less than 10 molar percent of silver iodide, the remaining halide being accounted for by silver bromide and/or silver chloride.

As noted, the present invention may be practiced with any form (i.e. cubic, octahedral, dodecahedral, spherical or tabular) of silver halide grains. It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain.

The photographic elements of the present invention may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

In accordance with a particularly preferred aspect of the present invention, the alkynylamine dopants are utilized in the yellow dye-forming blue sensitive layer, preferably of a reversal film.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the elements of this invention, reference will be made to *Research Disclosure*, December 1978, Item 17643, and *Research Disclosure*, December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures*. The elements of the invention can comprise emulsions and addenda described in these publications and publications referenced in these publications.

As noted above, the silver halide emulsions employed in the elements of this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Additional dopants, such as compounds of copper, thallium, lead, bismuth, cadmium and Group VIII noble metals, can be present during precipitation of the silver halide emulsion. Other dopants include transition metal complexes as described in U.S. Pat. Nos. 4,981,781, 4,937,180, and 4,933,272.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure*, Item 308119, cited above, Section IV.

Suitable vehicles for the emulsion layer and other layers of elements of this invention are described in *Research Disclosure*, Item 308119, Section IX and the publications cited therein.

The elements of this invention can include couplers as described in *Research Disclosure*, Section VII, paragraphs D, E, F, and G and the publications cited therein. The couplers can be incorporated as described in *Research Disclosure*, Section VII, paragraph C, and the publications cited therein. Also contemplated are elements which further include image modifying couplers as described in *Research Disclosure*, Item 308119, Section VII, paragraph F.

The photographic elements of this invention can contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure*, Section VI, antistain agents and image dye stabilizers (*Research Disclosure*, Section VII, paragraphs I and J), light absorbing and scattering materials (*Research Disclosure*, Section VIII), hardeners (*Research Disclosure*, Section X), polyalkyleneoxide and other surfactants as described in U.S. Pat. No. 5,236,817, coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein.

The photographic elements of the invention can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid. With negative-working silver halide emulsions, the processing step described above provides a negative image. The described elements can be processed in the known C-41 color process as described in, for example, the British Journal of Photography Annual, 1988, pages 196-198. To provide a positive (or reversal) image, the color development step can be preceded by development with a non-chromogenic developing agent to develop exposed silver halide, but not form dye, and then uniformly fogging the element to render unexposed silver halide developable. Reversal processing of the element of the invention is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

It is expected that the present invention will also yield photographic elements that exhibit superior raw stock keeping ability, as well as superior latent image stability.

The present invention also relates to a process comprising precipitating the silver halide grains of a silver halide emulsion in the presence of a photographically effective amount of a dopant having the structure:

$$Y—NHCH_2C{\equiv}CR^3$$

wherein $R^3$ represents a hydrogen atom, aliphatic, carbocyclic, or heterocyclic group, which may be substituted or unsubstituted; and Y represents a nitrogen containing heterocyclic moiety.

A photographically effective amount is an amount necessary to achieve some photographic effect; e.g. the amount necessary to achieve increased sensitivity. An example of an amount of the alkynylamine that is effective to achieve increased sensitivity is between about 0.001 mmole per mole of silver and about 5.0 mmoles per mole of silver.

Preferred embodiments of the inventive process (e.g. preferred dopants and their levels of use) are evident from the preceding disclosure. Also, it is to be understood that precipitation conditions of the present invention can vary in accordance with what is commonly known in the art. For instance, in a preferred embodiment, such parameters as pAg and pH can range from about 7 to about 10 and from about 2 to about 7, respectively. Temperature during precipitation can range from 40° to 80° C., though temperatures outside this range are also specifically contemplated.

The following representative examples further illustrate this invention.

EXAMPLES

The compounds of the invention may be prepared by any methods known in the art. Examples of such methods can be found in U.S. Pat. Nos. 4,451,557 and 4,378,426, both of which are incorporated herein by reference.

The examples below utilized silver bromide and iodobromide tabular emulsions of mean diameter that was greater than or equal to 0.3 microns, and an aspect ratio exceeding 7:1, at least 50% of the projected area of micrographs being contributed by such grains. Net iodide content ranged from 0% to 3%. When present, iodide was introduced by uniform incorporation, discontinuous introduction of an iodide-rich seed emulsion or soluble iodide salt, or by any combination of these methods. In all of the examples, an organic solution of the alkynylamines was introduced into the precipitation reactor during the latter half of grain growth. Emulsions so treated were then chemically and spectrally sensitized.

EXAMPLE 1

Tabular AgBrI emulsions with a uniform iodide phase

Silver iodobromide tabular grain emulsions were precipitated and washed according to conventional practices. The reactor was charged with a solution containing water, a peptizing agent, and a halide salt, e.g. NaBr. Nucleation of the AgBrI tabular grains by double-jet addition of a soluble silver salt and a halide salt mixture with vigorous mixing occurred at a temperature between 30° C. and 50° C., with pH less than or equal to 3.5, and a constant halide excess yielding a pAg between 9.0 and 10.5. Iodide was present at levels up to 3 mole percent. A ripening agent was present at levels up to 0.5 mole per mole of silver nucleated. Following nucleation, additional peptizer was added and reactor conditions adjusted such that temperature was between 40° C. and 80° C.; pH was between 5.0 and 6.0; and pAg was between 8.6 and 9.0.

Specifically, Control Emulsions A and C ($AgBr_{0.97}I_{0.03}$) were prepared according to the above scheme and yielded tabular emulsions having a medium thickness of 0.15 microns and an equivalent circular diameter of 2.7 microns. Experimental emulsions were prepared identically up to a fixed percentage of the total precipitated silver (Q). At this point (Q), a solution of an alkynylamine in a suitable solvent was added to the reaction mixture, which was then held at quiescent conditions for a short time. Double-jet precipitation of AgBr was then resumed for the remaining 100-Q percent of the total silver halide. Physical dimensions and grain morphology of chemically treated emulsions were indistinguishable from those of the control.

Each emulsion was subjected to an identical sensitization sequence determined to give optimum speed/fog performance with the controls. The principal ingredients per mole of silver halide were: $1.2\times10^{-3}$ moles of benzoxazolocyanine sensitizing dye; $6.6\times10^{-6}$ moles of gold from a labile gold reagent; and $3.1\times10^{-5}$ moles of sulfur from a labile sulfiding agent.

Other adjuvants such as a thiocyanate salt, and benzothiazolium salts were applied. Chemical ripening was accomplished by the application of a thermal cycle determined to give optimal speed with minimal fog. A ten minute hold at 63° C. was used in these experiments. A stabilizer—the sodium salt of 5-methyl-5-triazole-2,3-pyrimidine-7-ol—was then added.

A mixture of sensitized emulsion with a colloidal dispersion of a suitable dye-forming coupler and additional gel was coated on a clear support with antihalation protection, in combination with a hardening agent and surfactants as required to obtain uniform spreading. Dry coatings received a stepped exposure on a Type I-b sensitometer having a light source of color temperature 5500 K from which ultraviolet radiation was removed by means of a Wratten® (trademark of Eastman Kodak Company) Type 2B filter. Coatings were then processed through standard process E-6, known in the art, to yield a color-reversal dye image, or through C-41, also known in the art, to yield a negative dye image. Relative reversal speeds were measured as the difference in exposure required to reduce the maximum dye density by a fixed amount, specifically 0.3. Relative negative speeds were measured at 0.15 above Dmin.

In the Tables below, emulsions A and B represent a different coating set than emulsions C through G. Relative speed is expressed in units of 100*log(exposure) versus the control. Fog is expressed as the percent of Dmin relative to Dmax in a standard 6 minute E6-rehalogenation process, or as Dmin for a 3.25 minute C-41 process.

Results are summarized in Table II. Amounts are expressed in moles of compound G per final mole of silver halide precipitated. Treatment during precipitation with an alkynylaminobenzoxazole induced substantial speed increases. Speed increases were observed in both E-6 and C-41, both processes of commercial importance. Fog increases were minimal when small amounts of the alkynylamine were incorporated (see emulsions B, D, E and G). Emulsion G showed that speed gains of more than one stop with only minor fog elevation are obtainable.

TABLE II

| | | | | Reversal Processing | | Negative Processing | |
|---|---|---|---|---|---|---|---|
| Emulsion | Alkynylamine | Moles | Q | Fog % | Speed | Dmin (Fog) | Speed |
| A | none | none | — | 5% | 100 | — | — |
| B | Compound G | $8\times10^{-6}$ | 98% | 5% | 116 | — | — |
| C | none | none | — | 4% | 100 | .09 | 100 |
| D | Compound G | $11\times10^{-6}$ | 95% | 5% | 114 | .09 | 113 |
| E | Compound G | $27\times10^{-6}$ | 95% | 14% | 130 | .16 | 105 |
| F | Compound G | $54\times10^{-6}$ | 90% | 52% | 242 | .53 | 123 |
| G | Compound G | $27\times10^{-6}$ | 90% | 8% | 132 | — | — |

Susceptibility to pressure-induced desensitization was measured by comparing sensitometric curves with and without the application of mechanical pressure to a film by means of mechanical pinch rollers. A difference in exposure required to yield a fixed density (D=0.5) in the toe region of a reversal curve was the quantitative measure of desensitization, expressed as delta-toe (DEL-TOE). Ideally, a value of 0.0 was desired for this measure. Comparison Emulsion X was a 3%-iodide tabular emulsion of essentially the same dimensions as described above wherein iodide was introduced as an instantaneous dump of AgI seed emulsion. Results are given in Table III.

TABLE III

| Emulsion | C/I | Compound | Speed | DEL-TOE |
|---|---|---|---|---|
| X | Control | none | 126 | −35 |
| A | Control | none | 100 | +2 |
| B | Invention | Compound G | 116 | −1 |
| X | Control | none | 138 | −27 |
| C | Control | none | 100 | +3 |
| D | Invention | Compound G | 114 | −2 |

Control Emulsion X exhibited sufficient speed, but it did so at the expense of desensitization when subjected to mechanical pressure. Control Emulsions A and C exhibited little desensitization when subjected to mechanical pressure, but exhibited inferior speed. Only Emulsions B and D exhibited both sufficient speed and little or no susceptibility to pressure-induced desensitization.

EXAMPLE 2

Tabular emulsions with a nonuniform iodide phase structure

Emulsions I-N were silver iodobromide tabular grain emulsions having bulk iodide content of 2%. Iodide was introduced as AgI seed emulsion dump after 55% of the total silver halide had precipitated. Iodide was incorporated into the main AgBr population by recrystallization, which was found to introduce iodide phases having iodide content substantially greater than that of the bulk or average of the grain.

Precipitation was conducted in a reactor charged with water, a peptizing agent, and halide salts such as sodium bromide. Nucleation occurred by single-jet addition of a soluble silver salt at 40° C., pAg equal to 10, pH equal to 5.8, under conditions of vigorous stirring. Temperature was then increased to 60° C. and the peptizer and water added, along with the halide salts and acids or bases as required to establish the proper conditions (e.g. pH) for crystal growth. The pAg equal to 9.3 and the pH equal to 6.0. Double-jet addition of soluble silver and bromide salts, at a constant halide excess, grew the twinned crystals. After 50% of silver was precipitated, halide excess was decreased to give pAg equal to 7.9. Double-jet precipitation continued at this low halide excess until 55% of silver was precipitated, at which point a quantity of iodide-rich seed emulsion (Lippmann AgI) was introduced. Precipitation continued at low halide excess until 62% of silver was precipitated, at which point one of the alkynylamines of this invention were (for non-control emulsions) added, followed by a quiescent hold of suitable length. The remainder of the precipitation was conducted at the same low halide excess. The emulsion was then concentrated and excess electrolytes removed.

Emulsions of this example had equal median grain sizes of 1 micron and median thicknesses of 0.1 micron. Emulsions J-N were prepared identically to control I, except that an alkynylamine dopant was added to the reactor at the indicated point. All emulsions were sensitized as described in Example 1 above, under conditions determined to give optimum speed at low fog for each emulsion. Coating and testing procedures were as described above.

Results from standard reversal and negative processing of model coatings are summarized in Table IV.

TABLE IV

| | | | | Reversal Processing | | Negative Processing | |
|---|---|---|---|---|---|---|---|
| Emul | Compound | moles | Q | Fog % | Speed | Dmin (Fog) | Speed |
| I | none | none | 62% | 4% | 100 | 0.09 | 100 |
| J | B | $1 \times 10^{-4}$ | 62% | 7% | 112 | 0.10 | 106 |
| K | G | $1 \times 10^{-4}$ | 62% | 7% | 121 | 0.10 | 114 |
| L | H | $1 \times 10^{-4}$ | 62% | 33% | 174 | 0.14 | 149 |
| M | B | $1 \times 10^{-3}$ | 62% | 9% | 124 | 0.10 | 117 |
| N | G | $1 \times 10^{-3}$ | 62% | 31% | 175 | 0.13 | 146 |

As can be seen from Table IV, incorporation of various levels of alkynylamine dopants during precipitation of a substantial portion of each silver halide grain in a photographic element yields elements which exhibit exceptional speed gains. Such gains can be achieved without a substantial concomitant formation of fog.

This invention has been described in detail with reference to preferred embodiments thereof but it will be understood that variations and modifications can be effected with the spirit and scope of the invention.

What is claimed is:

1. A photographic element comprising a silver halide emulsion, said emulsion comprising silver halide grains which contain an alkynylamine dopant.

2. The photographic element of claim 1 wherein the alkynylamine dopant has the structure $$Y{-}NHCH_2C{\equiv}CR^3$$

wherein $R^3$ represents a hydrogen atom, aliphatic, carbocyclic, or heterocyclic group, which may be substituted or unsubstituted; and Y represents a nitrogen containing heterocyclic moiety.

3. The photographic element of claim 2 wherein the alkynylamine dopant has the structure

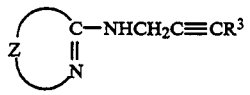

wherein Z represents atoms necessary to complete a five to nine-membered heterocyclic ring system; and $R^3$ is defined as in claim 2.

4. The photographic element of claim 2 wherein the alkynylamine dopant has the structure

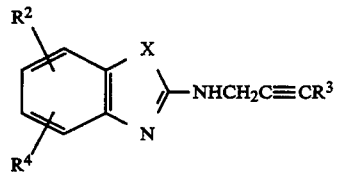

wherein X represents substituted nitrogen; or oxygen, sulfur, or selenium; $R^3$ is as defined in claim 2; $R^2$ and $R^4$ independently represent hydrogen, a halogen, or a substituted or unsubstituted alkyl or alkoxy group.

5. The photographic element of claim 4 wherein X is oxygen.

6. The photographic element of claim 5 wherein the silver halide grains are comprised of silver bromide or silver iodobromide.

7. The photographic element of claim 6 wherein the silver halide grains are comprised of silver iodobromide.

8. The photographic element of claim 5 wherein the silver halide emulsion comprises silver halide tabular grains having an aspect ratio greater than about 7:1.

9. The photographic element of claim 8 wherein the alkynylamine dopant is contained in the silver halide emulsion in an amount between about 0.001 mmole per mole of silver and about 5.0 mmoles per mole of silver.

10. The photographic element of claim 9 wherein the alkynylamine dopant is contained in the silver halide emulsion in an amount between about 0.002 mmole per mole of silver and about 1.0 mmole per mole of silver.

11. The photographic element of claim 10 wherein the alkynylamine dopant is contained in the silver halide emulsion in an amount between about 0.005 mmole per mole of silver and about 0.1 mmole per mole of silver.

12. The photographic element of claim 11 wherein the alkynylamine dopant is selected from the group consisting of Compound G:

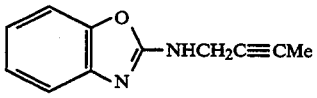

Compound H:

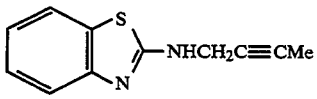

Compound I:

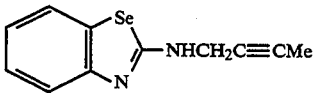

Compound J:

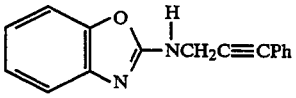

Compound K:

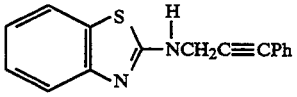

Compound L:

-continued

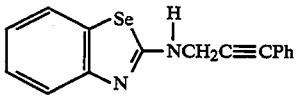

Compound M:

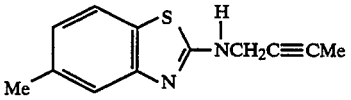

Compound N:

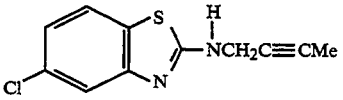

Compound O:

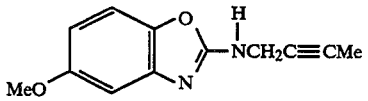

Compound P:

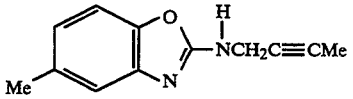

and

Compound Q:

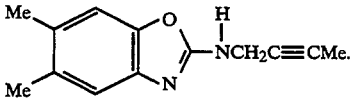

13. The photographic element of claim 2 wherein $R^3$ is an aliphatic group, a carbocyclic group, or a heterocyclic group.

14. The photographic element of claim 13 wherein $R^3$ is a methyl group.

15. A photographic element comprising silver halide grains doped with a photographically effective amount of a heterocyclic alkynylamine.

* * * * *